United States Patent [19]

Okado et al.

[11] Patent Number: 4,521,655

[45] Date of Patent: Jun. 4, 1985

[54] ELECTRIC POWER SWITCH WITH SLOTTED COMMUTATION END PLATE

[75] Inventors: Hiroyuki Okado; Shigeru Masuda, both of Aichi; Teijiro Mori, Hyogo, all of Japan

[73] Assignee: Mitsubishi Denki Kabushiki Kaisha, Tokyo, Japan

[21] Appl. No.: 463,359

[22] Filed: Feb. 2, 1983

[30] Foreign Application Priority Data

| | | | |
|---|---|---|---|
| Feb. 3, 1982 | [JP] | Japan | 57-15749 |
| Feb. 3, 1982 | [JP] | Japan | 57-15750 |
| Mar. 19, 1982 | [JP] | Japan | 57-43935 |

[51] Int. Cl.[3] ..... H01H 33/20

[52] U.S. Cl. ..... 200/147 R; 200/144 R; 335/132; 335/201

[58] Field of Search ..... 200/147 R, 144 R; 335/132, 201

[56] References Cited

U.S. PATENT DOCUMENTS

| | | | |
|---|---|---|---|
| 3,564,176 | 2/1971 | Fechant | 200/144 R |
| 4,237,355 | 12/1980 | Fechant et al. | 200/147 R |

FOREIGN PATENT DOCUMENTS

| | | | |
|---|---|---|---|
| 1027280 | 4/1958 | Fed. Rep. of Germany | 200/144 R |
| 1051935 | 3/1959 | Fed. Rep. of Germany | 200/144 R |
| 839301 | 6/1960 | United Kingdom | 200/144 R |
| 962820 | 7/1964 | United Kingdom | 200/147 R |

*Primary Examiner*—Robert S. Macon

*Attorney, Agent, or Firm*—Sughrue, Mion, Zinn, Macpeak and Seas

[57] ABSTRACT

In an electric power switch in which an arc generated between movable and stationary contacts 6, 14 migrates to an arc runner 15 and a commutation end plate and is extinguished by a grid 2 arranged therebetween, a cut is formed at least in the lower half of the end plate which confronts the grid, whereby the end of the arc is driven towards the center of the end plate and away from a surrounding arc box 1.

13 Claims, 8 Drawing Figures

ELECTRIC POWER SWITCH WITH SLOTTED COMMUTATION END PLATE

BACKGROUND OF THE INVENTION

This invention relates to electric power switches, and more particularly to an improved commutation plate adapted to constrain the migration of the end of an arc formed on the movable contact of such a switch.

In a conventional power switch as schematically shown in FIG. 1 the end portion of the commutation plate 3 is bent in the form of an upwardly open U-shaped groove. An opening 3*b* extends across the bottom of the groove and up the side thereof opposite a grid confronting end plate 3*a*, and a contact 6 on a movable contact arm 5 is disposed in the opening 3*b* thus formed.

When an arc is generated at off-center position P on the end plate 3*a*, the values of the current components $i_1$ and $i_2$ flowing into the arc from the commutation plate 3 are substantially equal to each other, and the sum (i) of the components $i_1$ and $i_2$ is the arc current. As is apparent from FIG. 1, $1_1 > 1_2$ at position P. Accordingly, the force $F_1$ of the current $i_1$ affecting the arc is larger than the force $F_2$ of the current $i_2$, as a result of which the arc is driven in the direction of the force $F_1$. The arc is thus shifted directly toward an arc box surrounding the grid, which is likely to damage the arc box.

Similar constructions are also disclosed in U.S. Pat. Ser. No. 4,237,355, and in commonly assigned copending application Ser. No. 380,314, filed May 20, 1982.

SUMMARY OF THE INVENTION

Accordingly, an object of this invention is to provide an electric power switch in which a central cut or slit is formed in the commutation plate to prevent any damage to the arc box. The effect of such a cut is to drive an arc formed on the grid confronting surface of the commutation plate toward the grid, whereby an electric power switch can be provided in which the arc box is protected from damage.

DETAILED DESCRIPTION OF THE PREFERRED EMBODIMENTS

A first embodiment of an actual electric power switch according to this invention is constructed as shown in FIGS. 2 through 5.

Figure 2:
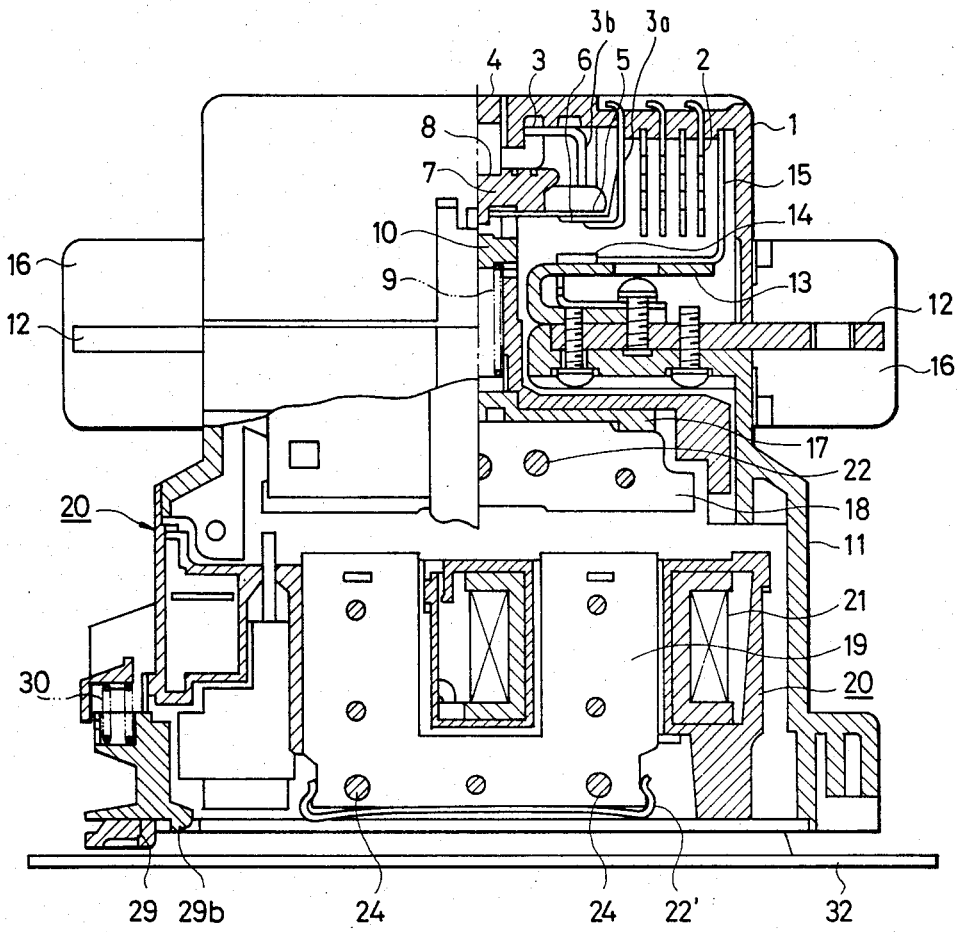
FIG. 2 is a front view, with parts cut away, showing a first embodiment of an actual electric power switch according to this invention.
Figure 3:
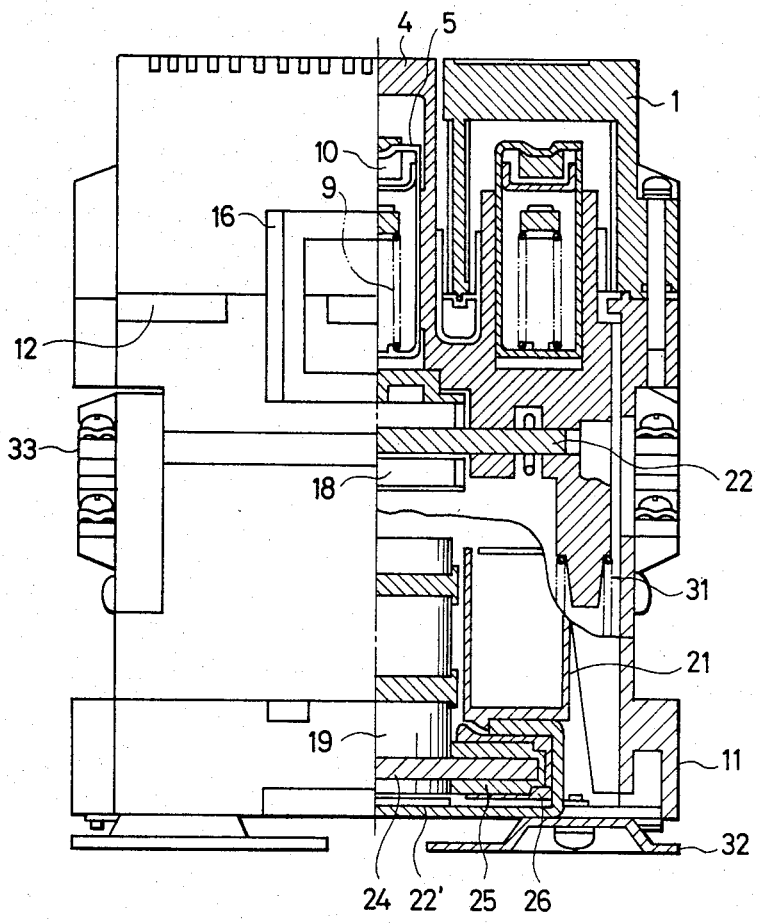
FIG. 3 is a side view, with one half in vertical section, showing the electric power switch of FIG. 2.

In FIGS. 2 and 3 an arc-extinguishing arc box 1 made of heat-resisting material fixedly mounts commutation plates 3 and grids 2 made of magnetic material in correspondence to the number of electrical phases to be switched on and off. Other components include a cross-bar 4, a movable contact arm 5, contacts 6 on both ends of the arm, a movable contact retainer 7, a retaining spring support 8, a contactor spring 9, and a stop 10.

The contactor spring 9 is fixed under tension between the lower portion of the stop 10 and the lower portion of the retaining spring support 8. The upper portion of the retaining spring support 8 abuts against the upper surface of the movable contact retainer 7, while the upper surface of the movable arm 5 abuts against the lower surface of the retainer 7, when assembled. The stop 10 is inserted into a hole in the cross-bar 4.

Further in FIGS. 2 and 3, reference numeral 11 designates a base having an open bottom and a side opening 11*a* (FIG. 4) for withdrawing an electromagnetic drive device (described later), 12 designates terminals secured to the upper portion of the base 11 with screws, 13 is a U-shaped stationary contactor which is secured to the upper surface of the terminal 12 with screws, a stationary contact 14 being secured to the upper surface of the stationary contactor 13, 15 is an arc runner secured to the stationary contactor 13, and 16 is an insulating barrier for electrically insulating the terminals 12 from one another. The insulating barrier is fixedly secured by being partially inserted in grooves formed in the arc box 1 and the base 11. Reference numeral 17 designates a movable rubber cushion, 18 is a movable iron core which is fixedly coupled to the lower portion of the cross-bar 4 by pins 22, 19 is a stationary iron core which is spaced a predetermined distance from the movable core 18, and 20 is an electromagnetic drive control device through which the legs of the stationary core 19 extend.

Figure 1:
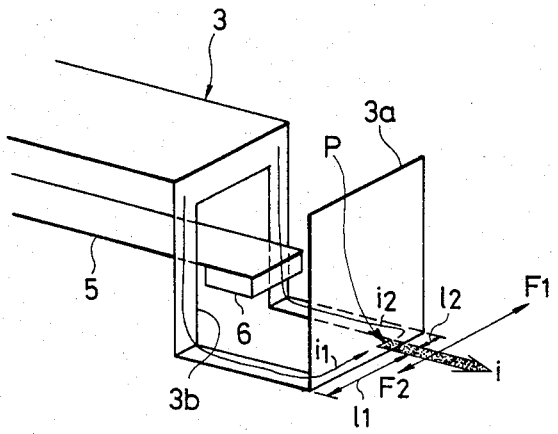
FIG. 1 PRIOR ART
FIG. 1 is an enlarged schematic perspective view of the essential components of a conventional electric power switch.
Figure 5:
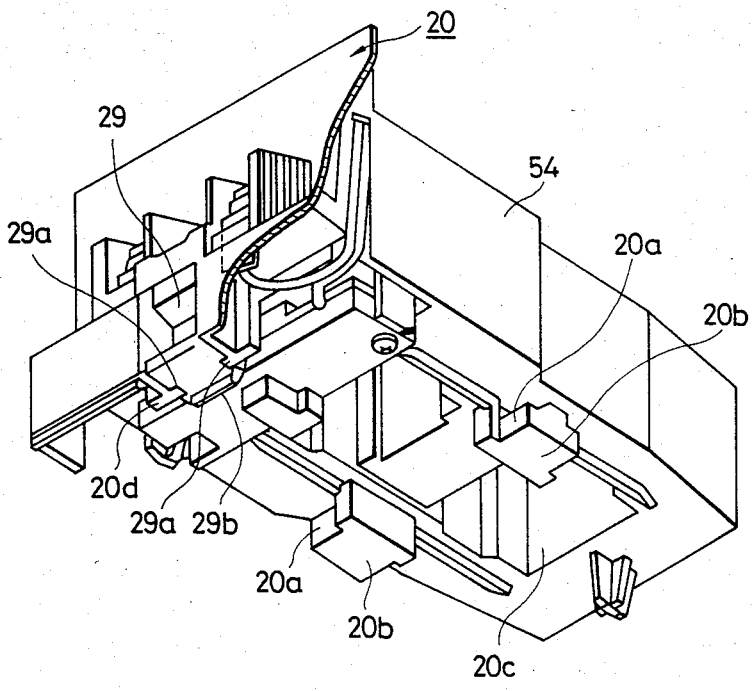
FIG. 5 is a perspective view of the drive control device of FIG. 2, as viewed from below.
Figure 4:
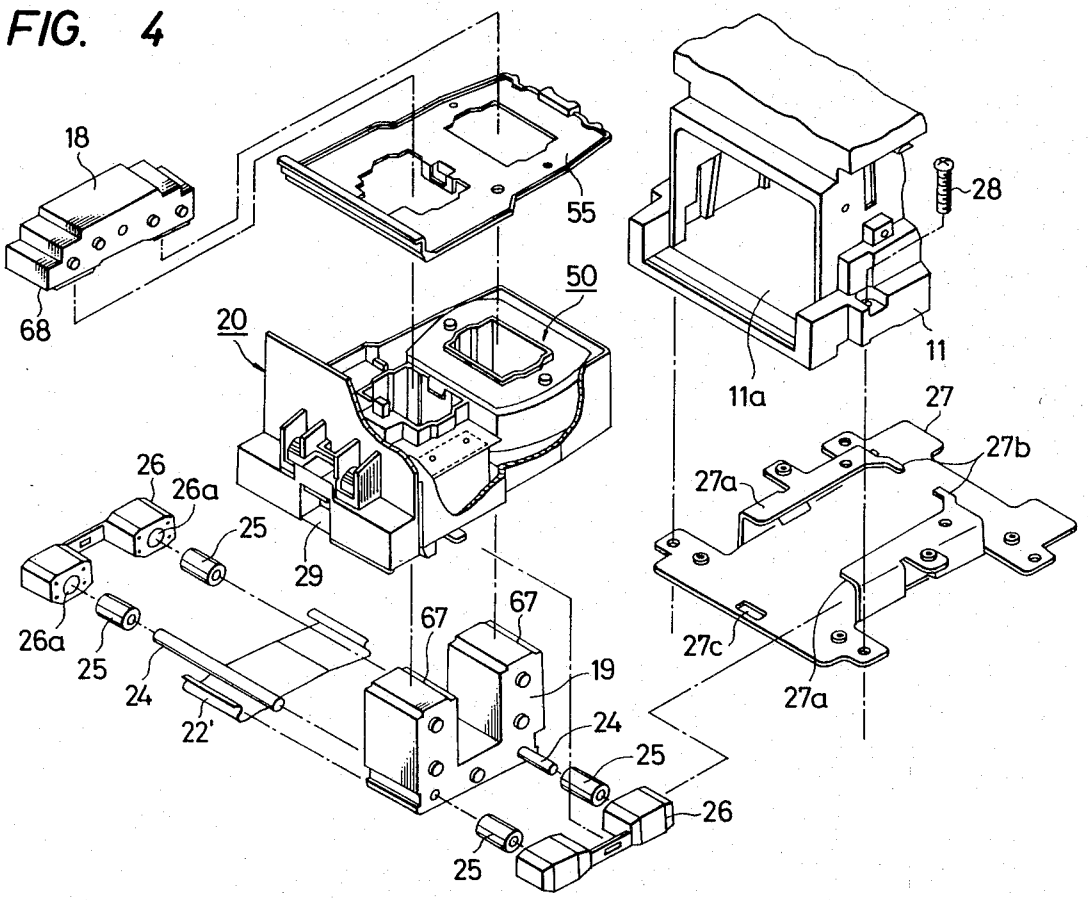
FIG. 4 is an exploded perspective view showing the drive section for operating the movable iron core of FIGS. 2 and 3.

The drive control device 20 (FIG. 5) includes an electromagnetic coil 21, and rail engaging pieces 20*b* for forming U-shaped recesses 20*a*. Reference character 20*c* designates a through-hole into which a leg of the core 19 is inserted. Reference character 22' designates a stationary cushion spring mounted on the lower portion of the core 19, the spring 22' serving to relieve any shock which may be imparted to a mounting board (not shown) when the electromagnetic contactor is operated. Reference numeral 24 designates pins which penetrate through the lower portion of the core 19 as shown in FIGS. 2 and 3, with both ends protruding from the core into rubber cushions 25 inserted into guides 26 made of low friction material. Each guide 26 has recesses 26*a* at both ends, the diameter of which is substantially equal to the outside diameter of the cushions 25. Reference numeral 27 designates a rail plate which has two parallel, U-shaped rails 27*a* at its midportion. The rails 27*a* have rail stoppers 27*b* at their deepest ends. The rail plate is secured to the base 11 with screws 28. The drive control device 20 has a ratchet 29, as shown in FIGS. 4 and 5, having vertically movable recesses 29*a* engaged with a vertical protrusion 20*d* of the drive control device, biased downwardly by a return spring 30. The ratchet 29 has a protrusion 29*b* at its lower end which engages a slot 27*c* in the rail plate 27. A trip spring 31 is disposed between the lower end of the cross-bar 4 and the upper surface of the rail plate 27 to urge the cross-bar upwardly. An apertured mounting plate 32 for securing the electromagnetic contactor to a panel (not shown) is secured to the bottom surface of the rail plate. Auxiliary contacts 33 are secured to the side of the base 11. The arc box 1 is screwed to the base 11, and the cross-bar 4 is vertically guided by the inner wall of the base 11. As shown in FIG. 2, the arc runner 15 is divided into two parts: a first part substantially parallel with the stationary contactor 13, and a second part substantially perpendicular thereto.

In operation, and referring to FIGS. 2 and 3, upon the application of a drive voltage to the control device 20, the latter forms magnetic flux which produces an attractive force between the movable iron core 18 and the stationary iron core 19. As a result, the cross-bar coupled to the movable core 18 is pulled downwardly against the force of the spring 31, so that the movable contacts 6 are brought into engagement with the stationary contacts 14. The open gap between them is smaller than the gap between the movable core 18 and the stationary core 19. Therefore, the cross-bar 4 continues to move downwardly until the cores are brought into contact with each other, which compresses the spring 9. The elastic force of the spring, in this operation, is transmitted through the support 8 and the retainer 7 to the contact arm 5, so that the terminals 12, which form an electrical path, are electrically connected under a predetermined contact pressure.

When the voltage to the drive control device 20 is interrupted, the electromagnetic attraction between the cores 18 and 19 is broken, whereby the cross-bar 4 is moved upwardly by the compressed spring 31 and the contacts are disengaged. This generates an arc between the movable contact 6 and the stationary contact 14. The feet or ends of the arc migrate from the movable contact 6 to the commutation plate 3 and from the stationary contact 14 to the arc runner 15, respectively, and the arc is further driven into the grid 2 by the electromagnetic repulsion force between the arc current and the contactor current. As a result, the arc is cooled, divided, and finally extinguished. The electrical path between the terminals 12 can thus be switched on and off by controlling the voltage applied to the drive control device 20.

Figure 6:
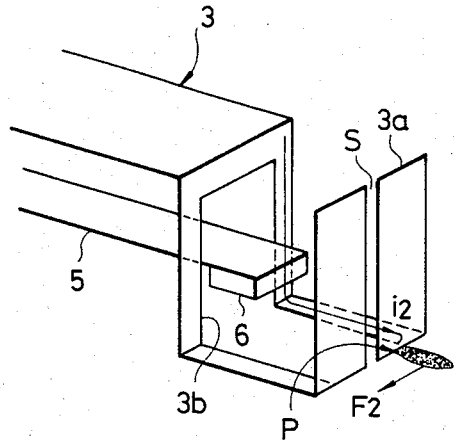
FIG. 6 is a simplified schematic perspective view of the essential components of the first embodiment of the electric power switch.

In the first embodiment schematically shown in FIG. 6, the grid confronting end plate 3*a* of the commutation plate 3 has a vertical slit S which divides it into two parts.

Figure 7:
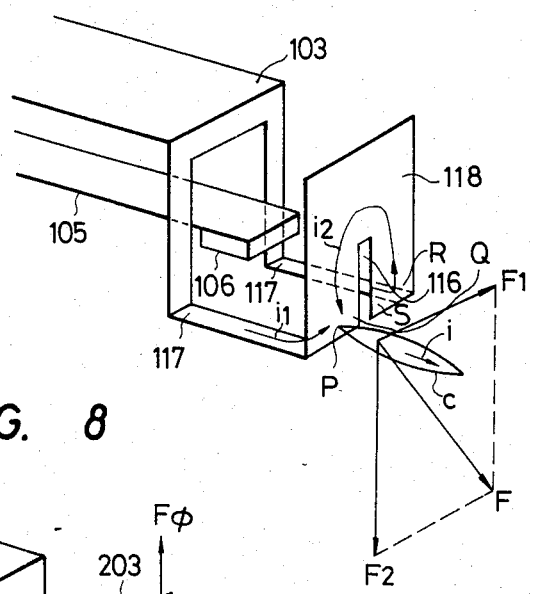
FIGS. 7 and 8 are simplified schematic perspective views showing second and third embodiments of the electric power switch according to the invention.

Accordingly, as shown in FIG. 6 in association with FIG. 7, the force $F_1$ due to the current $i_1$ is eliminated, and the arc is driven only by a force $F_2$ due to the current $i_2$. In other words, the arc which migrates from the movable contact 6 to the end plate 3*a* is always driven towards the center of the end plate. Accordingly, the arc never jumps to or contacts the arc box directly to damage it, which greatly improves the durability of the switch.

In the second embodiment schematically shown in FIG. 7, reference numeral 105 designates a movable contact arm, 106 is a movable contact, and 103 is a commutation plate having a pair of legs 117, a grid confronting end plate 118, and a slit 116 cut in the lower half of the end plate.

When the switch contacts are opened an arc is produced, which shifts to the legs 117 of the commutation plate and to the arc runner (not shown). Eventually the arc spans the gap between the end plate 118 and the confronting arc runner surface as indicated by reference character C. One foot of the arc is at point P on the end plate, while the other foot is at a predetermined position (not shown) on the arc runner surface. The arc current i flows in the direction of the arrow, and $i=i_1+i_2$.

An arc driving force $F_1$ due to the current $i_1$ is produced transversely along the end plate, while a force $F_2$ due to the current $i_2$ is produced downwardly as shown in FIG. 7. The resultant force F is directed towards the wall of the arc box (being perpendicular to the commutation plate and adjacent to the side surface thereof) in a plane including the end plate, and the foot of the arc at point P is thus moved towards point Q.

Similarly, when the foot of the arc is established at point R on the end plate, it is forcibly driven towards point S.

Accordingly, the arc foot can never jump away from the end plate; i.e., it is positioned near the slit 116 at all times. Thus, the problem of the arc contacting and damaging the wall of the arc box is eliminated. The slit 116 is shown as being rectangular, but this configuration is not limiting.

Figure 8:
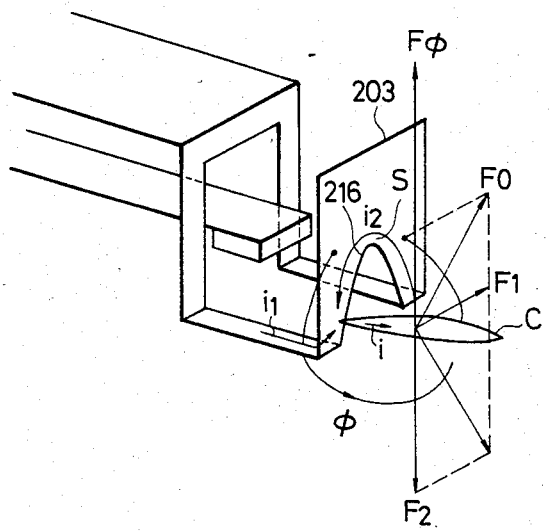

A third embodiment is schematically shown in FIG. 8, wherein a V-shaped cut 216 is formed in the end plate 203 which confronts the grid. With this construction the arc driving force $F_2$ due to the current $i_2$, being perpendicular to the force $F_1$ due to the current $i_1$, will not drive the arc towards the side wall of the arc box, so that the arc C is driven towards the center of the end plate 203. At the same time, the arc current forms magnetic flux $\phi$ as indicated in FIG . 8, which creates a force $F_\phi$ to drive the arc towards the deepest point S of the V-shaped cut. Reference character $F_0$ designates the resultant of the forces $F_1$, $F_2$ and $F_\phi$.

As is apparent from the above description, the deformation of the commutation electrode due to arc thermal stress can be Positively prevented, and the arc is always driven towards the center of the end plate according to the invention. Therefore, even when the power switch is operated a great number of times, damage to the arc box is prevented.

In the third embodiment the V-shaped cut is employed; however, it may be replaced by a U-shaped cut. That is, all that is necessary is that the configuration of the cut allow the magnetic flux to form an electromagnetic driving force $F_\phi$.

While the invention has been described with reference to an electric power switch, the technical concept of the invention is equally applicable to other electric power switching means such as circuit breakers.

What is claimed is:

1. An electric power switch, comprising:

(a) a stationary contact (14), (b) a movable contact (6) confronting said stationary contact and adapted to be moved into and out of engagement therewith, (c) an arc runner (15) provided proximate said movable contact and electrically connected to said stationary contact, for providing a path of migration for the end of an arc formed when said movable and stationary contact engagement is broken, and (d) a commutation plate (3) disposed near the path of movement of said movable contact, for providing a path of migration for the other end of said arc from said movable contact, (e) said commutation plate having an end plate for guiding said other end of the arc, and a cut at a central portion of said end plate, whereby said other end of the arc is driven towards the center of said end plate.

2. An electric power switch as claimed in claim 1, wherein said commutation plate has a pair of legs positioned on both sides of the path of movement of said movable contact, and the end plate merges with said legs.

3. An electric power switch as claimed in claim 2, wherein said cut is formed in a portion of said end plate which is closest to said legs.

4. An electric power switch as claimed in claim 2, wherein said cut is in the form of a slit.

5. An electric power switch as claimed in claim 4, wherein said slit is a through slit and divides the end plate into two halves.

6. An electric power switch as claimed in claim 4, wherein said slit extends only partially across said end plate.

7. An electric power switch as claimed in claim 2, wherein said cut is U-shaped or V-shaped.

8. An electric power switch as claimed in claim 1, wherein an arc extinguishing grid (2) is provided between said arc runner and said end plate, and said end plate confronts said grid.

9. An electric power switch as claimed in claim 8, wherein the commutation plate includes a strap portion disposed parallel to an arm (5) mounting the movable contact, a first pair of spaced legs depending downwardly from an end of the strap portion and flanking the movable contact, a second pair of spaced legs extending parallel to the strap portion from lower ends of the first pair of legs, and said end plate extending upwardly from distal ends of the second pair of legs, the first and second pairs of legs and the end plate thus having an upwardly open U-shape.

10. An electric power switch as claimed in claim 9, wherein said cut is formed in a portion of said end plate which is closest to said second pair of legs.

11. An electric power switch as claimed in claim 10, wherein said cut is in the form of a slit.

12. An electric power switch as claimed in claim 11, wherein said slit extends only partially across said end plate.

13. An electric power switch as claimed in claim 10, wherein said cut is U-shaped or V-shaped.

* * * * *